US007506641B2

(12) United States Patent
Ishida

(10) Patent No.: US 7,506,641 B2
(45) Date of Patent: Mar. 24, 2009

(54) IGNITION DEVICE

(75) Inventor: Yoshio Ishida, Osaka (JP)

(73) Assignee: Diamond Electric Mfg. Co., Ltd., Osaka (JP)

( * ) Notice: Subject to any disclaimer, the term of this patent is extended or adjusted under 35 U.S.C. 154(b) by 97 days.

(21) Appl. No.: 11/523,020

(22) Filed: Sep. 19, 2006

(65) Prior Publication Data

US 2007/0062501 A1 Mar. 22, 2007

(30) Foreign Application Priority Data

Sep. 20, 2005 (JP) ..... 2005-271618
Jan. 26, 2006 (JP) ..... 2006-018174
Jul. 19, 2006 (JP) ..... 2006-196557

(51) Int. Cl.
*F02P 3/05* (2006.01)
*F02P 3/055* (2006.01)

(52) U.S. Cl. ..... 123/618; 123/644

(58) Field of Classification Search ..... 123/604, 123/605, 625, 634, 637, 644, 618, 596, 636, 123/655, 656; 336/110
See application file for complete search history.

(56) References Cited

U.S. PATENT DOCUMENTS 4,099,509 A * 7/1978 Hashimoto ..... 123/652
5,056,496 A * 10/1991 Morino et al. ..... 123/604
6,052,002 A * 4/2000 Kinge ..... 123/604
6,305,365 B1 * 10/2001 Maeoka et al. ..... 123/604
7,100,589 B2 * 9/2006 Toriyama ..... 123/604
2002/0066444 A1 * 6/2002 Ikeda et al. ..... 123/606
2005/0263144 A1 * 12/2005 Toriyama ..... 123/604

FOREIGN PATENT DOCUMENTS

JP 3-15659 A 1/1991
JP 2811781 B2 8/1998
JP 11-210607 A 8/1999

* cited by examiner

*Primary Examiner*—Mahmoud Gimie
(74) *Attorney, Agent, or Firm*—Birch, Stewart, Kolasch & Birch, LLP

(57) ABSTRACT

A first series circuit having an energy storage coil 21, a first diode 3, and a capacitor 6 connected between a direct current power supply E and a ground terminal GND is arranged. A second series circuit of a switching element 5 and an ignition coil 4 is connected to both ends of the capacitor 6. The switching element 5 of the ignition device configured as above is controlled so as to perform a plurality of ON/OFF operations in time of the ignition operation of the ignition plug 8 connected to the secondary side of the ignition coil 4. As a result, the capacitive discharge and the inductive discharge are alternately repeated at the ignition plug 8. According to the present invention, a multiple discharge type ignition device in which the number of components is reduced, and the power consumption is suppressed is realized.

14 Claims, 13 Drawing Sheets

IN CASE OF SW_ON

IN CASE OF SW_OFF

OPERATION SIGNAL S
IN TIME OF IDLING
IN TIME OF STEADY STATE OPERATION
TS
t0
tn

BASE POTENTIAL (IGNITION PULSE)
Vs
①
②
③
④
t0
t1
t2
t3
tn
tm
COMBUSTION
COMBUSTION

COLLECTOR POTENTIAL
Vo

CURRENT OF ENERGY STORAGE COIL
i1

FIG. 4(A)
CRANKING INITIAL OPERATION
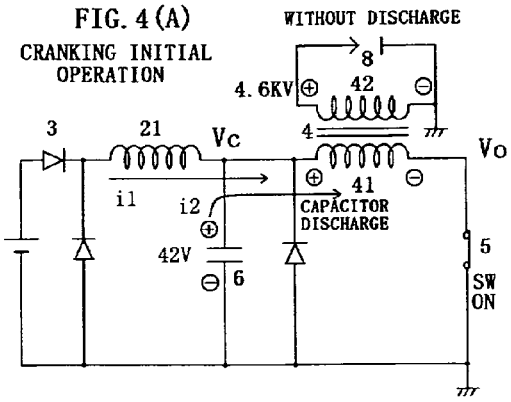
FIG. 4(B)
CRANKING INITIAL OPERATION
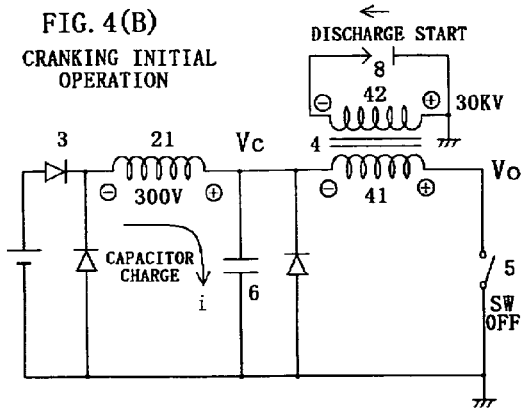
FIG. 5(A) t=t0 t=t2
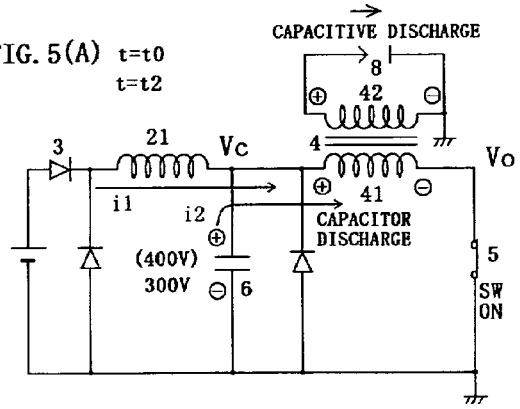
FIG. 5(B) t=t1 t=t3
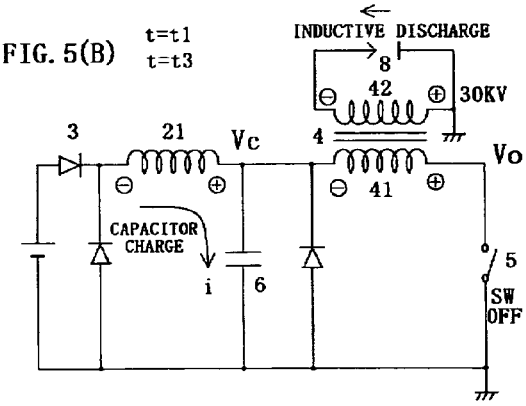
FIG. 5(C) t= tn
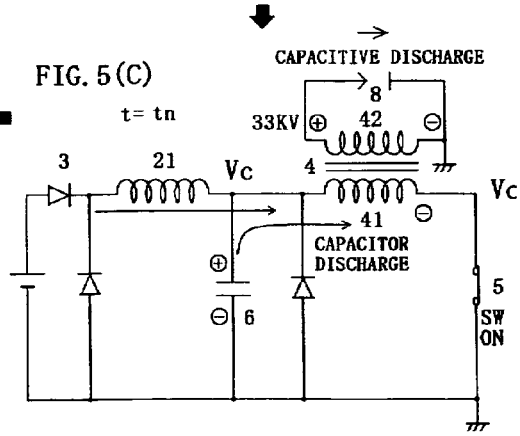
FIG. 5(D) t= tm (tn+0.4mS)
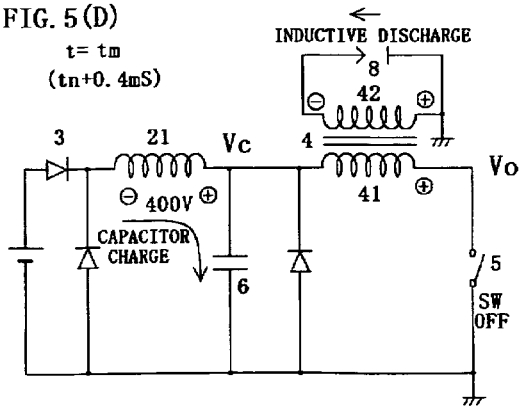

IN CASE OF SW_ON i1 CHARGING CURRENT TO ENERGY STORAGE COIL 21 i2 DISCHARGING CURRENT FROM CAPACITOR 6

IN CASE OF SW_OFF

IGNITION DEVICE

BACKGROUND OF THE INVENTION

1. Field of the Invention

The present invention mainly relates to an ignition device used in an internal combustion, and preferably functioning as a multiple ignition point type ignition device.

2. Description of the Prior Art

An ignition device of high energy is desired as the ignition device of the internal combustion to adapt to a high compression lean combustion (tenuous combustion) for recent exhaust gas countermeasure or for fuel consumption enhancement. For example, a multiple discharge type ignition device combining a capacitive discharge and an inductive discharge is disclosed in Japanese Patent No. 2811781 and Japanese Unexamined Patent Publication No. 11-210607.

SUMMARY OF THE INVENTION

In the ignition device, the power consumption increases the more, the number of discharges compared to the ignition device of the usual current shielding method, but a measure for reducing such power consumption has not been adopted. Further, two large capacity switching elements are required as a circuit configuration, and the number of components for the control circuit thereof is also extremely large; thus, the manufacturing cost increases. Furthermore, in the ignition device described above, pre-ignition may occur since a switching element that is in the ON state before the original ignition timing exists.

The present invention, in view of the above, aims to provide an ignition device that has less number of components and that can suppress the power consumption. Further, the ignition device in which useless power consumption is not produced since the switching element is not in the ON state until the ignition timing is reached and in which the possibility of malfunctioning is eliminated is provided.

In order to achieve the above aim, the present invention relates to an ignition device including a first series circuit with an energy storage coil, a backflow prevention element and a capacitor connected between a direct current power supply and a ground terminal, and a second series circuit including a current passage of a switching element and an ignition coil connected at both ends of the capacitor; wherein the switching element is controlled so as to perform one or more ON/OFF operations in time of ignition operation of an ignition plug connected to the secondary side of the ignition coil.

The present invention also relates to an ignition device including a third series circuit with an energy storage coil, a backflow prevention element, an ignition coil and a capacitor connected between a direct current power supply and a ground terminal, and a current passage of a switching element connected at both ends of a series connection of the ignition coil and the capacitor; wherein the switching element is controlled so as to perform one or more ON/OFF operations in time of ignition operation of an ignition plug connected to the secondary side of the ignition coil.

The present invention achieves a multiple discharge type ignition device in which a single switching element is sufficient for one ignition coil, and in which the capacitive discharge and the inductive discharge are alternately repeated with an extremely simple configuration. The capacitive discharge refers to the discharge of the ignition plug involved in the discharge of the electric charge accumulated in the capacitor, whereas the inductive discharge refers to the spark discharge of the ignition plug performed when the magnetic energy charged at the ignition coil is directly released.

According to the present invention, the period of the ON/OFF operation of the switching element is appropriately changed, and thus the degree of freedom of design in multiple discharges is enhanced. Further, according to the present invention, the switching element is ON/OFF operated at the operation period corresponding to the presence of the discharge at the ignition plug, and the suitable output power of the ignition coil necessary in the ignition discharge is obtained. Thus, the ignition device that achieves long discharging duration while suppressing the power consumption is obtained. Moreover, the discharging direction is sequentially inverted in multiple discharges, and thus the electrode of ignition plug is prevented from deteriorating.

In the present invention, a damper element for absorbing the oscillating current is preferably connected in parallel to the capacitor, or in parallel to the primary coil of the ignition transformer. An element (typically a diode) that is electrically conducted only in the forward direction is preferably adopted as the damper element. According to this configuration, the capacitor is not charged in the opposite direction, and thus the single capacitor can be commonly used by the ignition units of each cylinder when applying the present invention to the internal combustion of multiple cylinders.

This can be understood from FIGS. 13A to 13C showing the operation of FIGS. 6A to 6C. For example, in the configuration of FIG. 6B, the oscillation circuit is formed by the capacitor 6 and the primary coil 41 of the ignition coil 4 in time of the ON operation of the switching element 5. Thus, as shown in FIG. 13B, when the current in the opposite direction flows to the capacitor 6, such current in the opposite direction is divided into a plurality of ignition coils. If the diode 11 is connected in parallel with the capacitor 6 (see FIG. 13A) or the diode 11 is connected in parallel with the primary coil 41 of the ignition coil 4 (see FIG. 13C), the oscillating current does not flow, and thus current does not flow to the other ignition coils. However, the ON operation of the switching element 5 is preferably limited to once in the case of the configuration of FIG. 13C.

In the present invention, the power consumption is suppressed and the deterioration of the ignition plug is suppressed by appropriately setting the ON operation time of the switching element. In particular, the first ON operation time to start the combustion of the internal combustion or the last ON operation time of the ON/OFF operations repeated over a plurality of times are important. Preferably, the first ON operation or the last ON operation time are appropriately changed according to the rotation number of the internal combustion, the load condition of the internal combustion, or the power supply voltage.

Preferably, the present invention is configured so that a detecting means of a current to be monitored flowing to the energy storage coil or the switching element is arranged, the output of the detecting means being input to a driver of the switching element; and the switching element is controlled so as to be forcibly transitioned to the OFF state when the current to be monitored flowing at least in the last ON operation of the switching element reaches a predetermined upper limit value. When such configuration is adopted, the power supply power consumption in time of discharge at the ignition plug is reduced without lowering the output voltage of the ignition coil, and the number of multiple ignitions can be increased.

According to the present invention, the ignition device corresponding to a gasoline direct injection engine that uses high compression lean air-fuel mixture is achieved, and consequently, the internal combustion of low fuel consumption and low exhaust gas is achieved. In the present invention, with regards to the capacitive discharge and the inductive discharge alternately repeated at a relatively high frequency, the number of repetition and each discharge energy can be appropriately controlled. Specifically, the operation parameters such as the number of repetition of the ignition pulse, the switching period and the like are appropriately changed according to the rotation number of the internal combustion, the load condition of the internal combustion, or the fluctuation of the power supply voltage. The present invention responds to the higher voltage of the battery that is becoming diversified, realizing lowering of the power consumption and higher degree of freedom of design with a simple circuit configuration.

BRIEF DESCRIPTION OF THE DRAWINGS

FIGS. 4A and 4B are views each explaining the operation state in time of cranking for the ignition device of FIG. 1;

FIGS. 5A to 5D are views each explaining the operation state in time of idling and in time of steady state operation for the ignition device of FIG. 1;

DETAILED DESCRIPTION OF THE INVENTION

Figure 1:
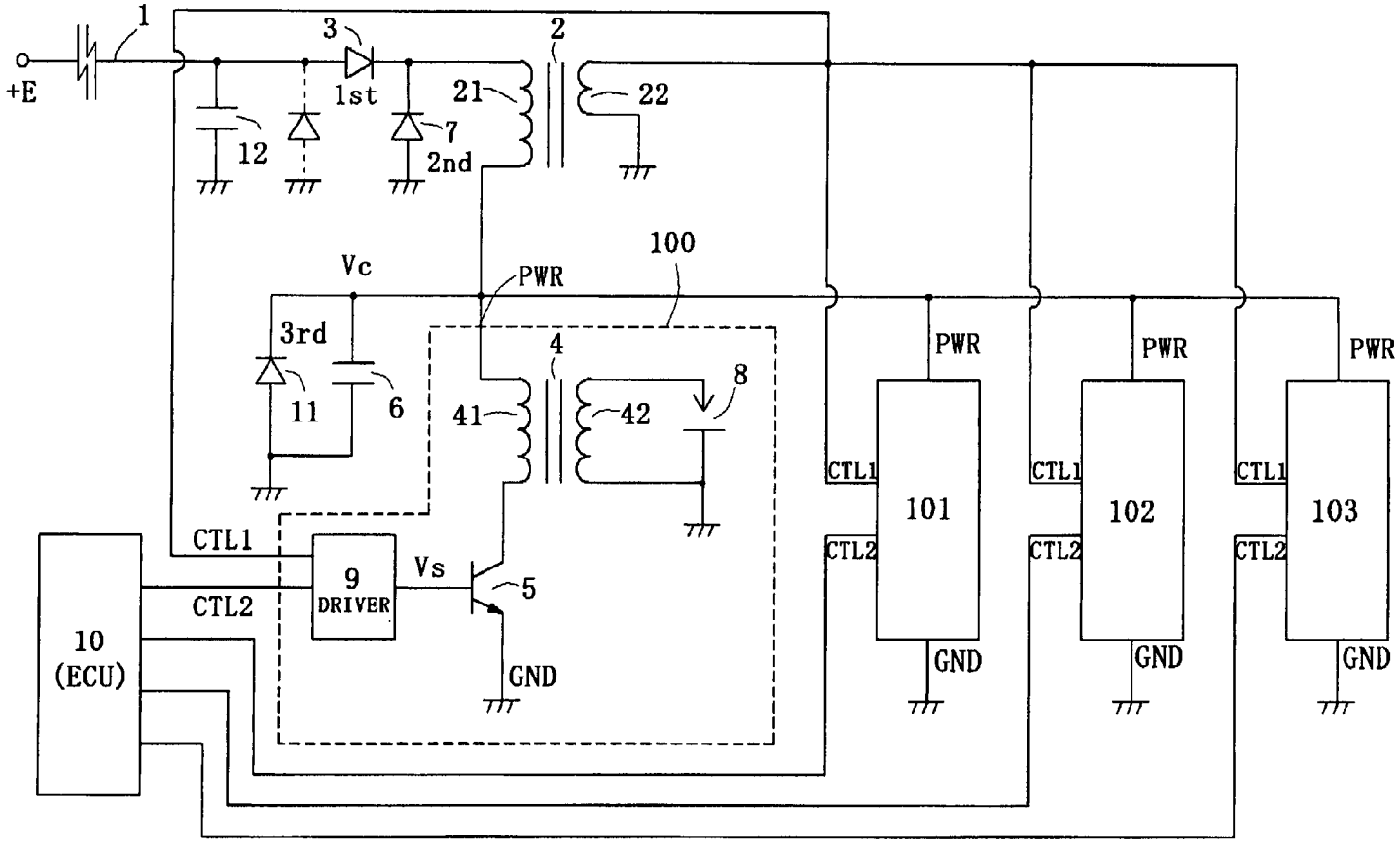
FIG. 1 is a circuit diagram showing an ignition device of a first embodiment.

FIG. 1 is a circuit diagram showing an ignition device of a first embodiment. The ignition device shown corresponds to a four cylinder internal combustion (automobile engine herein) and the like, and four ignition units 100, 101, 102 and 103 having the same configuration operate by mainly being controlled by an electronic control unit (ECU) 10. The ignition units 100 to 103 produce high voltage at both ends of an ignition plug 8 by the ON/OFF operation of a switching element 5 and time sequentially discharges the ignition plug 8 of each ignition unit 100 to 103.

The ignition units 100 to 103 each includes a power supply terminal PWR, a first control terminal CTL1, a second control terminal CTL2, and a ground terminal GND. The detection output of the current detection coil 22 is provided to the first control terminal CTL1, and the control signal of different phase is provided from the ECU 10 to the second control terminal CTL2. The detection output of the current detection coil 22 is proportional to the current value of the energy storage coil 21.

As shown in FIG. 1, the direct current power supply E (42 V) by the battery is supplied through a series circuit of the first diode 3 and the energy storage coil 21 to the power supply terminal PWR of the ignition units 100 to 103. As shown in the figure, the first diode 3 is connected so that forward current flows from the direct current power supply E towards the ignition units 100 to 103, and functions as a backflow prevention element.

The second diode 7 is connected so that forward current flows from the ground terminal GND towards the energy storage coil 21. The second diode 7 is an element functioning as a bypass path of the direct current power supply E. Therefore, the second diode 7 does not necessarily need to be connected on the downstream side of the first diode 3, as shown in the figure, and the second diode 7 may be connected on the upstream side of the first diode 3 (see broken line section of FIG. 1).

A capacitor 12 is connected between the power supply line 1 and the ground terminal GND. The capacitor 12 is actually realized by connecting a ceramic capacitor C1 and an electrolytic capacitor C2 in parallel. The capacitors C1, C2 not only absorb noise superimposed on the power supply line 1, but also form a bypass path of high frequency signal involved in the ON/OFF operation of the switching element 5. In the present embodiment, the switching element 5 can be ON/OFF operated at high speed without using expensive diodes 3, 7 excelling in frequency property since the capacitor 12 is arranged between the most downstream position of the power supply line 1 and the ground terminal GND.

A capacitor 6 and a third diode 11 are connected in parallel between each ignition unit 100 to 103 and the ground terminal GND. The third diode 11 is a damper for preventing the capacitor 6 from being charged in the negative direction, and absorbs oscillating current passing through the switching element 5.

The internal configuration of the ignition unit 100 will now be described, but other ignition units 101 to 103 also have the same configuration. The ignition unit 100 is configured by a transistor 5 serving as a switching element, a driver(drive circuit) 9 for realizing ON/OFF operation of the ignition unit by providing ignition pulse Vs to the transistor 5, and an ignition coil 4 connected to the collector terminal of the transistor 5. The ignition coil 4 is configured by a primary coil 41 and a secondary coil 42 that are electromagnetically coupled, and the ignition plug 8 is connected to the secondary coil 42. The emitter terminal of the transistor is grounded.

Figure 2A:
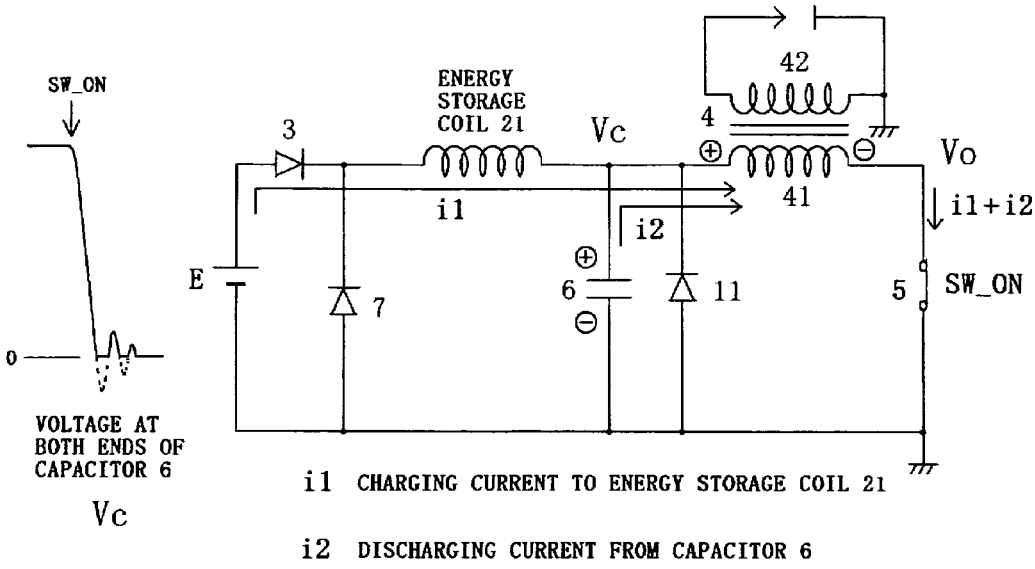
FIG. 2A is a view showing an equivalent circuit for when the switching element is in the ON state with respect to the ignition device of FIG. 1.

Next, the operation content of the ignition device of FIG. 1 will now be described with reference to FIGS. 2A and 2B. When the switching element 5 is ON operated, the ignition device of FIG. 1 equivalently becomes the circuit configuration of FIG. 2A, where the charging electric charge of the capacitor 6 is discharged through the primary coil 41 of the ignition coil 4, and the coil charging current i1 flows to the energy storage coil 21.

The circuit of the example is circuit designed so that the oscillating current flows through the capacitor 6, the primary coil 41, and the switching element 5 if the third diode 11 is not arranged. However, in reality, the third diode 11 is connected in parallel with the capacitor 6, and thus the voltage Vc at the ends of the capacitor 6 drastically drops at the same time as the ON operation of the switching element 5 and then stabilizes with the charging in the opposite direction prohibited. In other words, the voltage Vc at both ends of the capacitor 6 drastically change as shown on the left side of FIG. 2A.

Figure 2B:
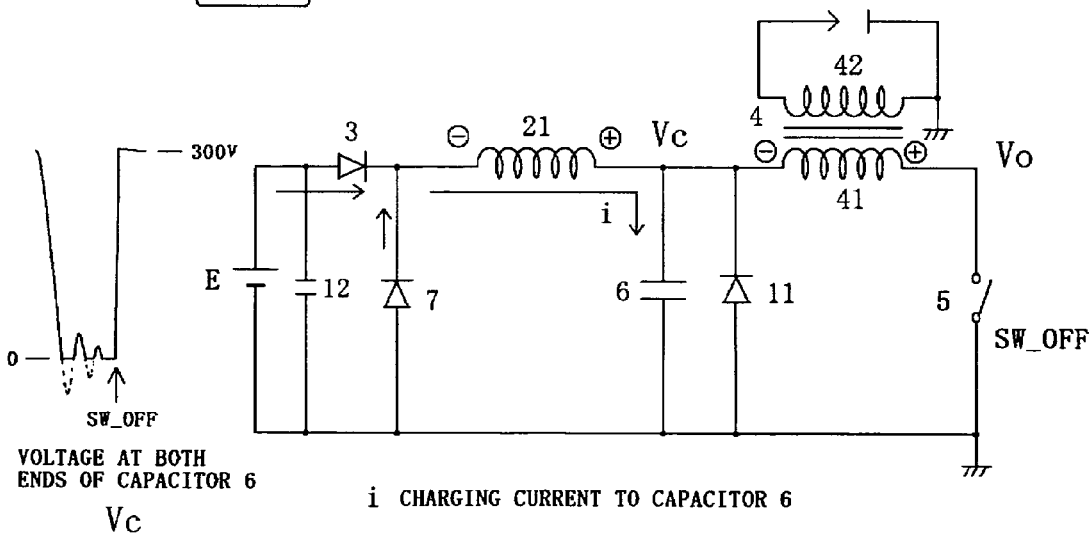
FIG. 2B is a view showing an equivalent circuit for when the switching element is in the OFF state with respect to the ignition device of FIG. 1.

If the switching element 5 is OFF operated, the ignition device of FIG. 1 equivalently becomes the circuit configuration of FIG. 2B, where the capacitor 6 is charged through the energy storage coil 21. Since the first diode 3 and the second diode 7 are present in the charging path of the capacitor 6, the voltage Vc at both ends of the capacitor 6 drastically rises to the highest value due to the rectifying action and then maintains such value. This relationship is as shown on the left side of FIG. 2B, where the capacitor 6 is charged to 300 V in the example shown.

In time of OFF operation shown in FIG. 2B, a large electromotive force in the opposite direction is produced in the direction shown at the energy storage coil 21. The voltage source by the energy storage coil 21 is added in series in addition to the direct current power supply E, and a large charging current to the capacitor 6 flows through the power supply line 1. In this case, even if the high frequency impedance increases as the power supply line 1 pulled around from the direct power supply E generally becomes long, the high frequency noise emitted from the power supply line 1 reduces since the power supply line 1 is bypassed by the second diode 7 and the power supply capacitor 12.

Figures 3A, 3B, 3C, 3D:
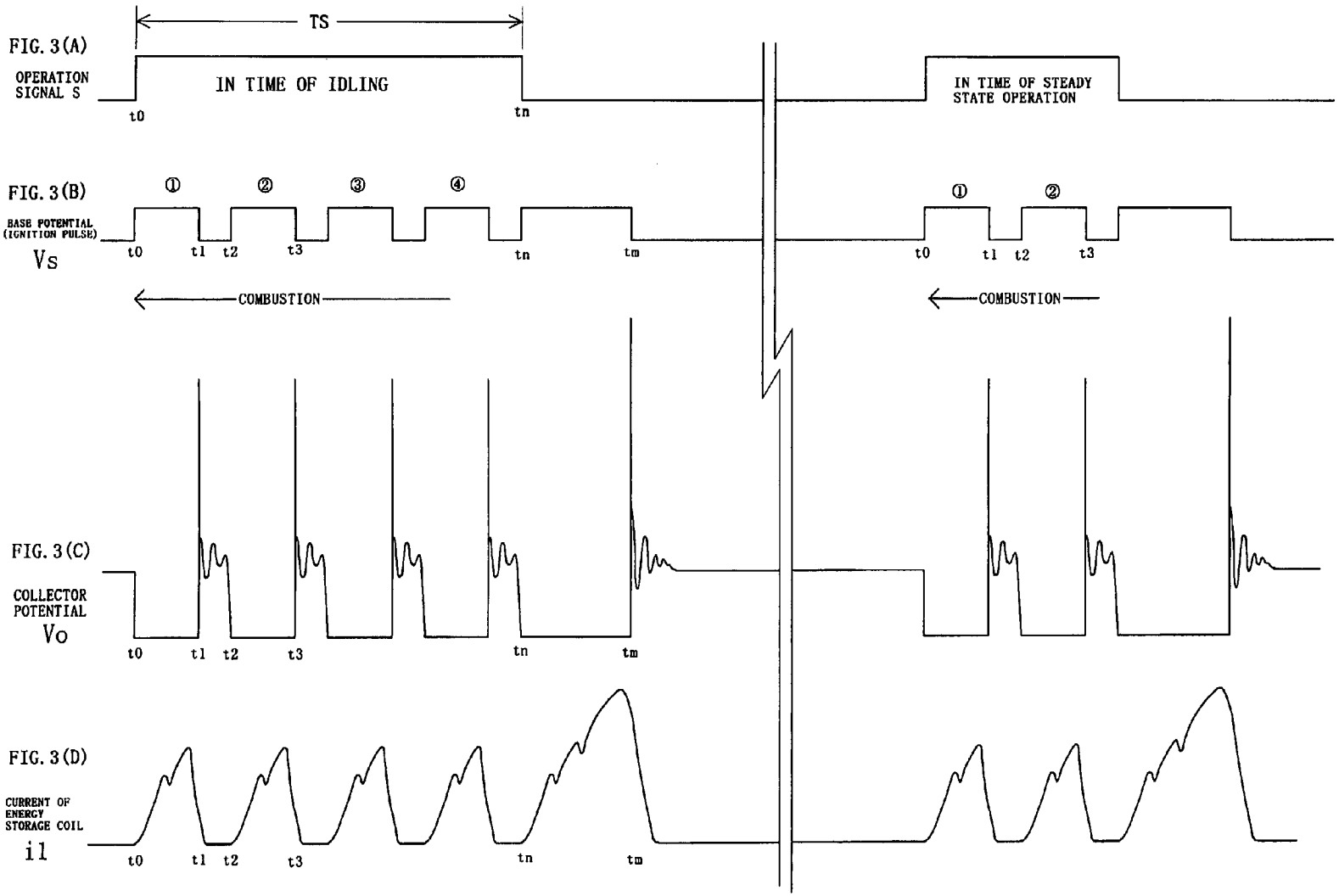
FIG. 3 is a timing chart showing the operation state for the ignition device of FIG. 1.

In view of such operation content, the operation content of the ignition device of FIG. 1 will now be described. FIG. 3 is a timing chart showing the operation content of the ignition device. The left half of FIG. 3 shows the ignition operation from idling at the start of operation of the internal combustion to the partial load, and the right half of FIG. 3 shows the ignition operation in steady state operation after reaching the steady state operation close to full load. FIGS. 4A and 4B respectively show the ignition operation of when the crank shaft is rotated (that is, in time of cranking) to start the internal combustion.

<Operation Until Start of Discharge in Time of Cranking>

The operation until the start of discharge in time of cranking will first be described based on FIGS. 4A and 4*b*. In the present embodiment, the ignition pulse Vs has the ON time Ton initialized to 0.22 mS and the OFF time Toff to 0.12 mS based on the control signal CTL2 from the ECU 10. When the current flowing through the energy storage coil 21 exceeds a predetermined upper limit value Imax (e.g., 12 A), however, the ignition pulse Vs is controlled so as to be forcibly made to the OFF state based on the control signal CTL1. Therefore, in the present embodiment, when the set value Ton of the ON time is exceeded, or the current upper limit value Imax of the energy storage coil 21 is exceeded, the switching element 5 is made to the OFF operation state by the ignition pulse Vs or the logic OR output thereof.

When the power supply voltage E of 42 V is supplied, the charging current i flows to the capacitor 6 through the energy storage coil 21 and the first diode 3, and the charging electric charge corresponding to the direct current supply 42 V is accumulated at the capacitor 6 (initial charging operation).

Then, when the switching element 5 receives the ignition pulse Vs of H level for the first time, the switching element 5 is ON operated, and the charging electric charge of the capacitor 6 is discharged through the primary coil 41 of the ignition coil 4 (see FIG. 4A). The coil charging current i1 flows to the energy storage coil 21, and storage of magnetic energy starts. The collector potential Vo of the switching element 5 becomes 0 V in correspondence to the ON operation of the switching element 5, and the voltage Vc at both end of the capacitor 6 also drastically drops towards 0 V (see FIG. 2A).

The induction voltage of about 4.6 kV is generated at the secondary coil 42 of the ignition coil 4 due to the start of the discharging operation from the capacitor 6, but the ignition plug 8 does not discharge in this step since the inner pressure of the cylinder of the internal combustion is high. Since the ignition plug 8 has not started the spark discharge, the current value of the energy storage coil 21 does not exceed the upper limit value Imax.

Thereafter, when the switching element 5 changes to the OFF state (see FIG. 4B), high voltage of about 30 kV is induced at the secondary coil 42 due to release of magnetic energy stored in the ignition coil 4, and the ignition plug 8 starts the spark discharge. That is, the ignition plug 8 starts the discharge, and combustion in the internal combustion starts at the timing the switching element 5 changes from the ON operation to the OFF operation. The back electromotive force of about 300 V is induced at the energy storage coil 21, and the capacitor 6 is rapidly charged to about 300 V. Therefore, when the switching element 5 is again ON operated thereafter, the high voltage is induced at the secondary coil 42 of the ignition coil 4 due to the discharging operation from the capacitor 6, and the discharge in the direction opposite from until that moment is performed in the ignition plug 8.

Thus, in the present embodiment, the ignition plug 8 does not discharge at the first ON operation of the switching element, and the discharge delay of about 0.22 mS occurs until the start of operation of the ignition plug 8. However, the delay time is not a problem since it is about 0.18 degree in terms of the delay angle of the number of cranking rotation.

<Operation in Time of Idling>

The ignition operation starts in the above manner, and the ignition operation in time of idling will now be described based on the timing chart (left side) of FIG. 3 and FIGS. 5A to 5D.

[t=t0]

When receiving the ignition pulse Vs of H level at a timing of t=t0 shown on the left side of FIG. 3, the switching element 5 changes from the OFF operation to the ON operation. The charging electric charge of the capacitor 6 is drastically discharged through the primary coil 41 of the ignition coil 4 (see FIG. 5A). The capacitor 6 is charged up to about 400 V in the final operation in time of cranking, and thus a large amount of electric charge is discharged to the ignition coil 4, whereby high voltage of greater than or equal to 40 kV is induced at the secondary coil 42 of the ignition coil 4, and the ignition plug 8 continues the discharge towards the right as shown. The collector potential Vo of the switching element 5 becomes 0 V ((B) in FIG. 3) in correspondence to the ON operation of the switching element 5, and the voltage Vc at both ends of the capacitor 6 drastically drops towards 0 V (see FIG. 2A).

The coil charging current i1 starts to flow to the energy storage coil 21 when the switching element 5 is ON operated, and storage of magnetic energy starts. The coil current i1 increases with the oscillation component as in (D) in FIG. 3. In FIG. 3, (D) is a current waveform of the energy storage coil 21 detected by the current detection coil 22.

The switching element 5 is forcibly transitioned to the OFF state when the current of the energy storage coil 21 exceeds the upper limit value Imax, but the current of the energy storage coil 21 is assumed as not exceeding the upper limit value Imax in the following description for the sake of convenience of the explanation.

[t=t1]

Assuming the current of the energy storage coil 21 does not exceed the upper limit value Imax, the switching element 5 is OFF operated at the timing of t1 (=T0+0.22 ms) before the spark discharge started from timing t0 is finished (FIG. 5B). The magnetic energy stored at the ignition coil 4 is then discharged, so that high discharge of about 30 kV is induced at the secondary coil 42, and the ignition plug 8 continues the discharging operation in the direction opposite from until that moment.

The voltage of about 300 V is induced at the energy storage coil 21 at this point, and the capacitor 6 is rapidly charged to about 300V (see FIG. 2B).

[t=t2]

The switching element 5 is ON operated again at the timing of t2 (=t1+0.12 ms) before the inductive spark discharge started from timing t1 is finished (FIG. 5A). The charging voltage 300 V of the capacitor 6 is then applied to the primary coil 41 of the ignition coil 4, and the high voltage of about 33 kV in the direction opposite from the previous discharge is induced at the secondary coil 42.

The discharging current is thus inverted and flowed to the ignition plug 8, and the storage of the magnetic energy starts at the energy storage coil 21.

[t=t3]

Thereafter, the switching element 5 is again transitioned the OFF operation state at the timing of t3 (=t2+0.22 ms) (FIG. 5B). The high voltage of about 30 kV is induced at the secondary coil 42 of the ignition coil 4, and the spark discharging current of the ignition plug 8 is again inverted and the discharge is maintained. The capacitor 6 is recharged by the electromotive force in the opposite direction of the energy storage coil 21.

Similarly, unless the current of the energy storage coil 21 exceeds the upper limit value Imax, the switching element 5 repeats the ON operation for 0.22 mS and the OFF operation for 0.12 mS. Furthermore, the capacitive discharge and the inductive discharge are alternately repeated at the ignition plug 8. As described above, the capacitive discharge is the spark discharge of the ignition plug 8 involved in the discharge of the electric charge accumulated in the capacitor 6, whereas the inductive discharge is the spark discharge of the ignition plug 8 of when the magnetic energy charged at the ignition coil 4 is directly discharged.

As shown in FIG. 3, the final ON operation is started at timing tn by the control of the ECU 10 after the switching element 5 repeats the ON/OFF operation over four times in the present embodiment (FIG. 5C). The ON operation is the operation of increasing the output voltage induced by the ignition coil 4 first in the next ignition timing. Thus, the ON time is set to about 0.4 mS longer than the ON time up to this moment. The current upper limit value Imax of the energy storage coil 21 is also set to 15 A etc. higher than before.

Due to such initialization, the magnetic energy stored in the ignition coil 4 becomes a level a few steps higher than the magnetic energy up to this moment, and the inductive discharge of the ignition plug 8 at timing tm becomes a high output (see (C) in FIG. 3). After the switching element 5 transitions to the OFF state (FIG. 5D, the inductive voltage of the energy storage coil 21 becomes about 400 V, and a sufficient charging electric charge is stored in the capacitor 6 and maintained to the next ignition timing in such state (see FIG. 5A).

<Operation of Steady State Operation>

The ignition operation of the steady state operation shown in the right half of FIG. 3 will now be described. When the ignition timing is reached, the switching element 5 is ON operated at timing t0. The sufficient charging electric charge charged at the capacitor 6 is discharged through the primary coil 41 of the ignition coil 4, and high voltage of greater than or equal to 40 kV is induced at the secondary coil 42 and the ignition plug 8 starts the spark discharge (FIG. 5A).

Then, the switching element 5 is OFF operated at the timing t1 (=t0 +0.22 mS) before the discharge started at timing t0 is finished. The charging of the capacitor 6 then starts by the induced voltage of the energy storage coil 21, and at the same time, the inverted discharging current flows to the ignition plug 8 (FIG. 5B) by the induced voltage of the secondary coil 42 of the ignition coil 4.

The switching element is then again transitioned to the ON operated state at the timing t2 (=t1+0.12 mS) before the discharge is finished, and the capacitive discharge by the discharge of the capacitor 6 is performed at the ignition plug 8 (FIG. 5A). Similarly, multiple discharges are continued as the switching element 5 is OFF operated at timing t3, and thereafter, the final ON operation is performed at timing tn to tm.

At the ignition operation of FIG. 3 described above, the pulse width of the operation signal S refers to the discharge continuing time TS of multiple discharges, where the discharge continuing time TS is appropriately determined in ECU based on the rotation number and the load condition of the internal combustion, or the value of the power supply voltage E. For example, as the rotation number of the combustion increases, the discharge continuing time TS must be set short in correspondence thereto (see right side of FIG. 3).

When setting the discharge continuing time TS short, the pulse width and the pulse period of the ignition pulse Vs may be shortened in correspondence to the discharge continuing time Ts, but in the present embodiment, they are not changed in principle, and only the number of switching is reduced. Thus, in the present embodiment, the output voltage of the ignition coil 4 does not lower at random in correspondence to the rotation number of the internal combustion and the like. In the embodiment, the minimum value for the number of switching is set to about two.

In the circuit configuration of the present embodiment, the output voltage of the ignition coil 4 changes based on mainly the energy storage conductive time to the energy storage coil 21, in other words, the ON time Ton of the switching element 5. Therefore, the ON time Ton is preferably set long when the power supply voltage is low as in time of the cranking or in time of the following idle rotation. In the present embodiment, the ON time Ton of the switching element is automatically shortened by the current limiting function in the energy storage coil 21 when the power supply voltage is in a relatively high state such as in fast rotation even if the ON time Ton serving as the initial value is set relatively long.

Therefore, the present embodiment suppresses the increase in the unnecessary power consumption since the current value of the energy storage coil 21 does not exceed the upper limit value Imax. That is, when the spark discharging current is large, the pulse width of the ignition pulse is automatically shortened based on the current value of the energy storage coil 21, and the unnecessary power consumption is reduced.

Generally, the initial discharging voltage of the ignition plug 8 of high compression state is required to be high voltage of about 25 kV, but once the discharge starts, the discharge can be continued even at low voltage of about 20 kV due to the ionization in the vicinity of the ignition plug 8. Thus, the pulse width or the pulse period of the ignition pulse Vs can be set relatively short, and the life span of the ignition plug can be extended by suppressing the output voltage of the ignition coil. The pulse width of the ignition pulse is determined and the output voltage of the ignition coil is suppressed based on the current value flowing through the energy storage coil 21, in which context, the life span of the ignition plug 8 is extended.

Figure 6A:
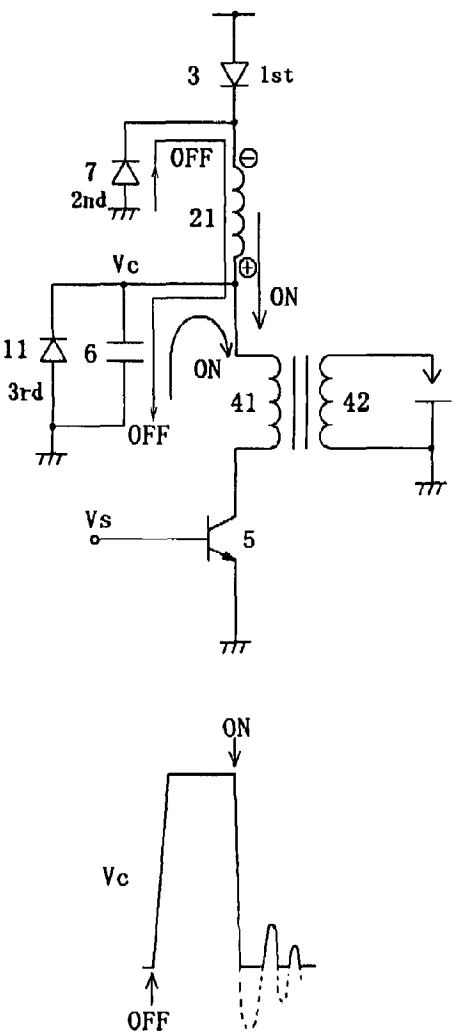
FIGS. 6A to 6C are circuit diagrams each showing a variant of the ignition device of FIG. 1.
Figure 6B:
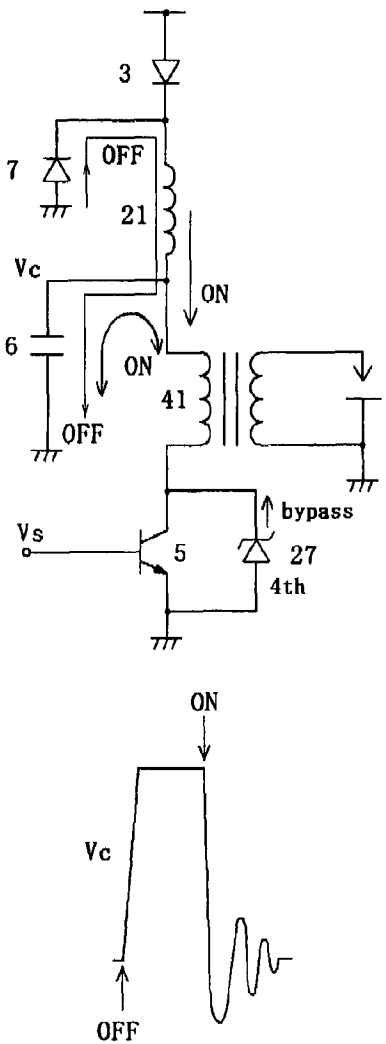
Figure 6C:
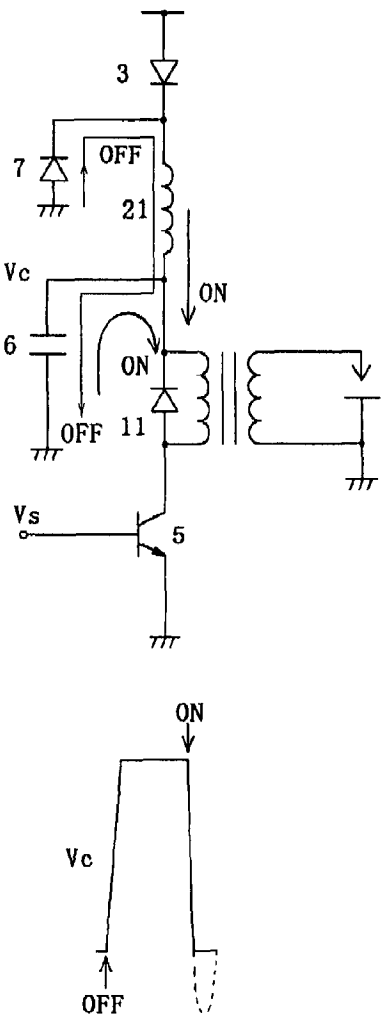

The ignition device of FIG. 1 has been specifically explained but is not limited to the circuit configuration of FIG. 1. FIG. 6A is a circuit diagram extracting the main part of the ignition device of FIG. 1, and FIGS. 6B, 6C are circuit diagrams modifying one part of FIG. 6A. FIG. 6B has the third diode 11 omitted from the circuit of FIG. 6A and a fourth diode 27 connected in parallel to the switching element. FIG. 6C has the third diode 11 connected to both ends of the primary coil 41 of the ignition coil in the circuit of FIG. 6B.

In the circuit of FIG. 6B, the third diode 11 is not present, and thus the capacitor 6 can be charged in either the positive or negative direction, and free oscillating current flows to the capacitor 6. Thus, the direct current component of the primary coil 41 and the second coil 42 of the ignition coil 4 is reduced, the copper loss in the ignition coil is suppressed and heat generation is reduced. The fourth diode 27 forms a bypass flow path of the current in the opposite direction of the switching element 5.

In the circuit configuration of FIG. 6C, the free oscillation caused by the capacitor 6 and the primary coil 41 is suppressed, similar to FIG. 6A. That is, after the discharge of the electric charge of the capacitor 6 is finished, the induced voltage in the opposite direction inducted at the primary coil 41 is thereafter absorbed at the third diode 11, and the free oscillation is suppressed. Therefore, the inductive discharge is suppressed and only depends on the leakage inductance of the secondary coil 42 of the ignition coil 4. Thus, the capacitive discharge becomes domineering, and practically, the number of switching of the switching element 5 is preferably limited to once. The ON operation time is set to be longer than other circuit configuration, and is, for example, about 0.6 mS to 2 mS.

Figure 7:
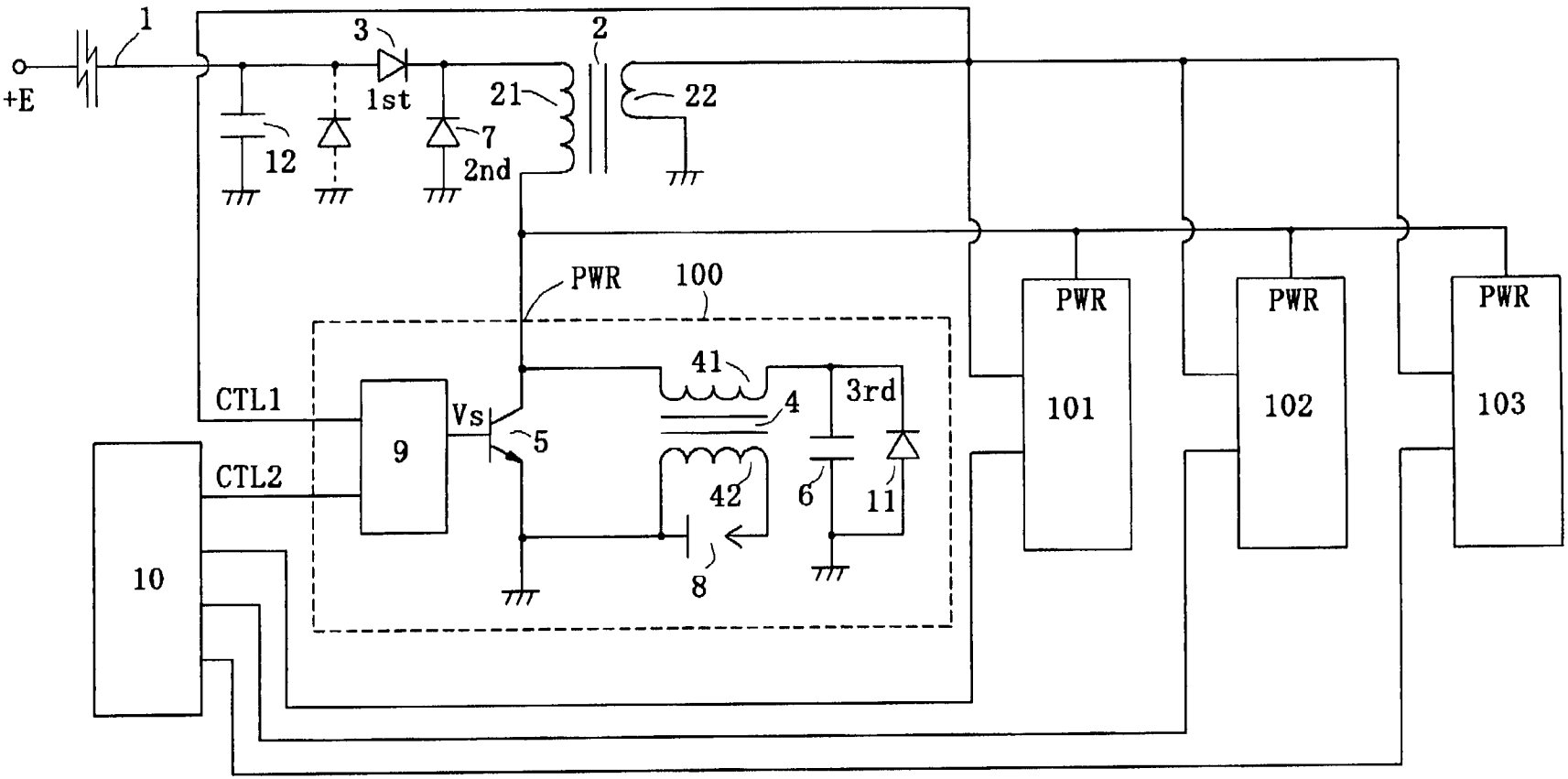
FIG. 7 is a circuit diagram showing an ignition device of second embodiment.

FIG. 7 is a circuit diagram showing an ignition device of a second embodiment, and the same reference characters are denoted for the same components as the ignition device of FIG. 1. The ignition device corresponds to the internal combustion of four cylinders and the like, and four ignition units 100, 101, 102 and 103 of the same configuration operate by mainly being controlled by the ECU 10. The detection output of the current detection coil 22 is provided to the first control terminal CTL1, and the control signal of different phase is provided from the ECU 10 to the second control terminal CTL2.

As shown in the figure, the direct current power supply E (42 V) is supplied by the battery through a series circuit consisting of the first diode 3 and the energy storage coil 21 to the power supply terminal PWR of the ignition units 100 to 103. The second diode 7 is connected so that the forward current flows from the ground terminal GND towards the energy storage coil 21, and the capacitor 12 is connected between the power supply line 1 and the ground terminal GND.

Each ignition unit 100 to 103 is configured by a transistor 5 serving as a switching element, a driver 9 for realizing the ON/OFF operation of the ignition unit by providing the ignition pulse Vs to the transistor 5, the ignition coil 4, the capacitor 6, and the third diode 11. The capacitor 6 and the third diode 11 are connected in parallel to each other, where anode terminal of the third diode 11 is grounded, and the cathode terminal is connected to the ignition coil 4.

Figure 8A:
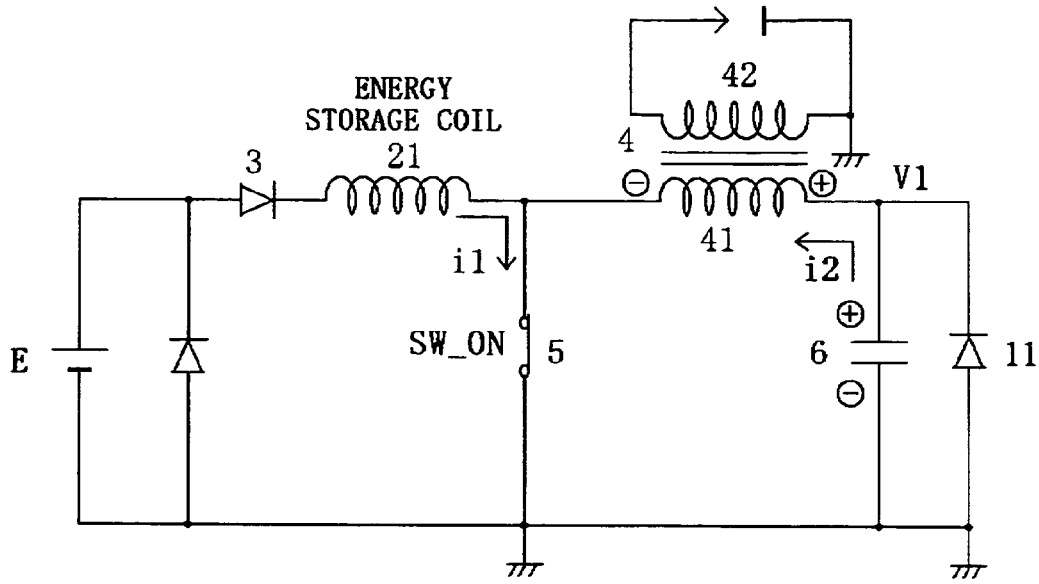
FIG. 8A is a view showing an equivalent circuit for when the switching element is in the ON state with respect to the ignition device of FIG. 7.

In the ignition circuit of FIG. 7 as well, the switching element 5 repeats the ON operation and the OFF operation based on the ignition pulse Vs. FIG. 8A shows an equivalent circuit of when the switching element 5 is in the ON state. In the ON state, the charging current i1 flows to the energy storage coil 21, and the discharging current i2 from the capacitor 6 flows to the primary coil 41 of the ignition coil 4 (see FIG. 9A).

Figure 8B:
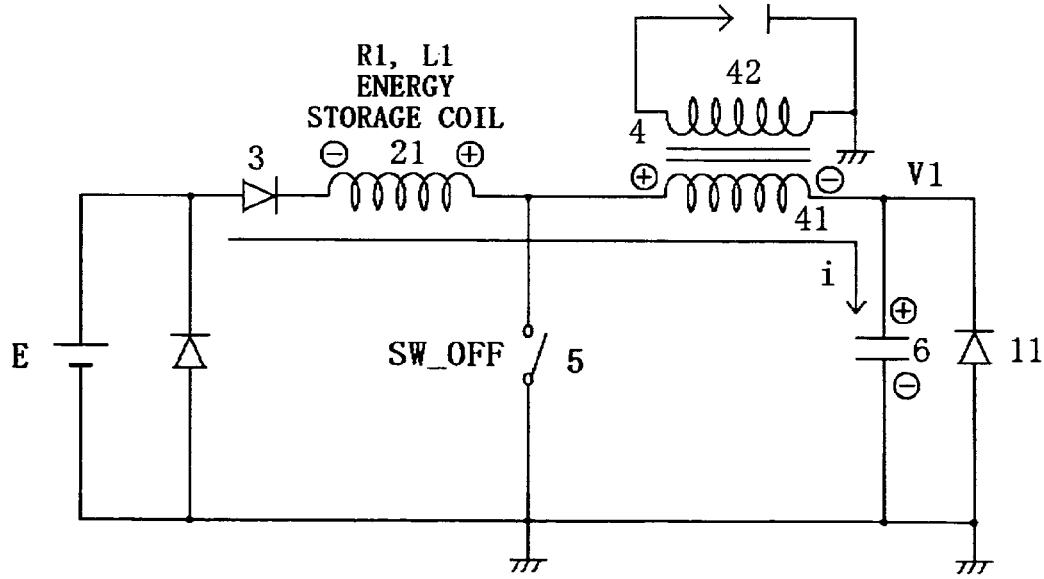
FIG. 8B is a view showing an equivalent circuit for when the switching element is in the OFF state with respect to the ignition device of FIG. 7.
Figure 9A:
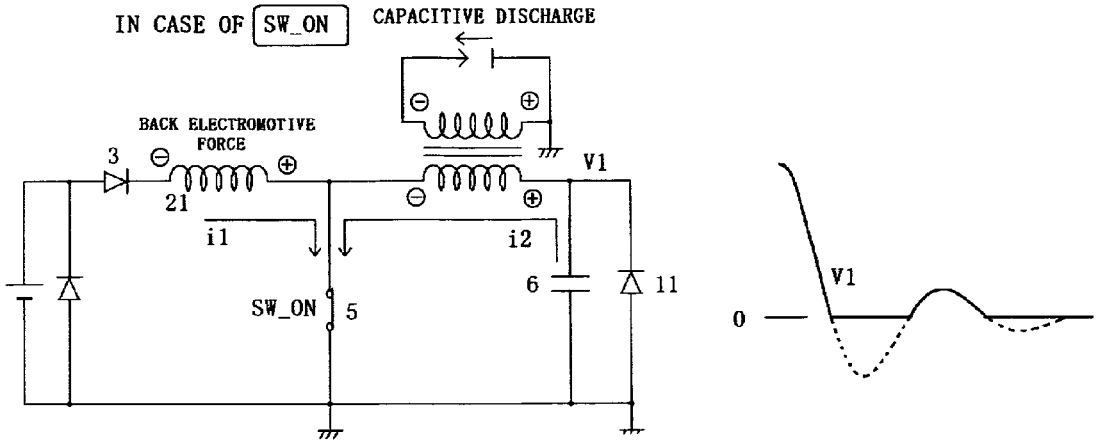
FIGS. 9A to 9C are views each explaining the operation state of an instant for the ignition device of FIG. 7.
Figure 9B:
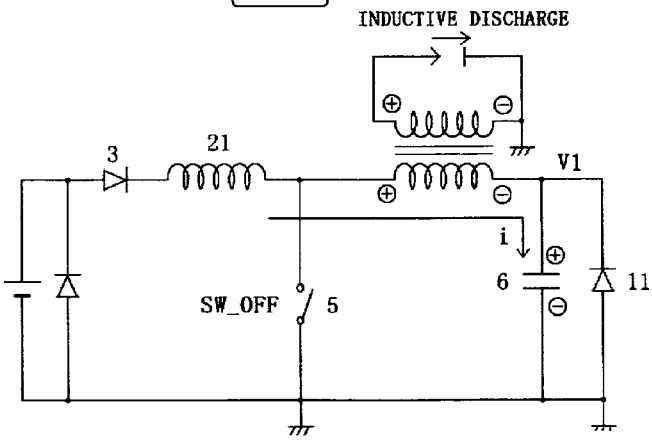

FIG. 8B shows an equivalent circuit of when the switching element 5 is in the OFF state. In the OFF state, the circuit is designed so that the oscillating current flows, but actually, the free oscillating current is suppressed since the third diode 11 is connected to the capacitor 6, and the capacitor 6 is not charged in the opposite direction (FIG. 9B). This is the same for the discharging operation of FIG. 8A (FIG. 9A).

Figure 9C:
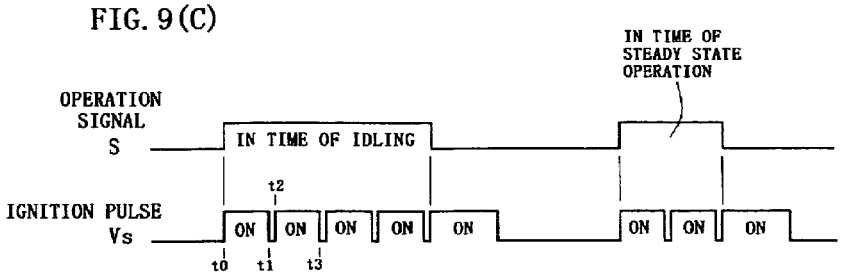

The operation content of the ignition device is substantially the same as the ignition device of FIG. 1, where the inductive discharge and the capacitive discharge are repeated (FIG. 9C). However, since the discharging current of the ignition plug 8 is assumed to be continuous, the OFF operation time of the switching element 5 must be set shorter or to less than or equal to 0.08 mS due to the designing restrictions of the magnetic discharging energy of the energy storage coil 21 and the capacity of the capacitor 11.

Figure 10A:
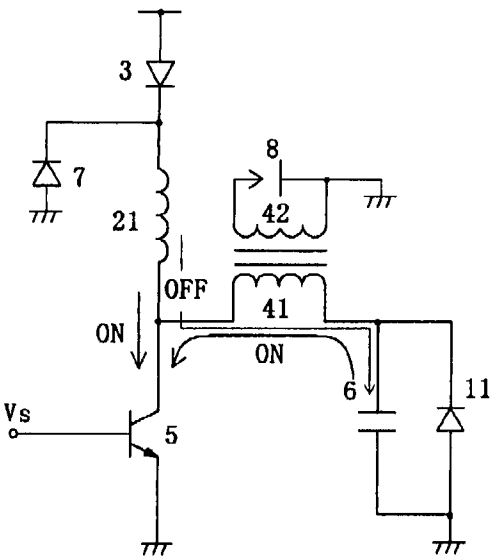
FIGS. 10A to 10C are circuit diagrams each showing a variant of the ignition device of FIG. 7.
Figure 10B:
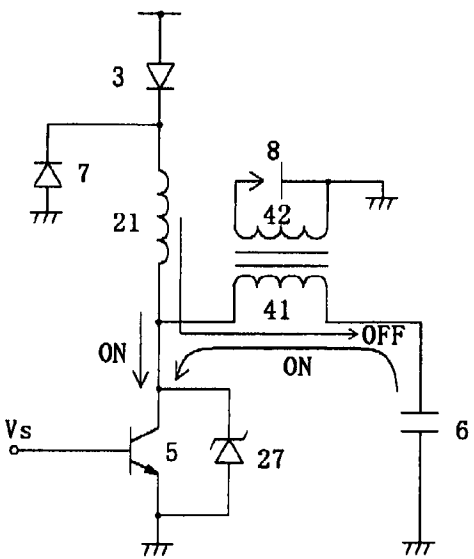
Figure 10C:
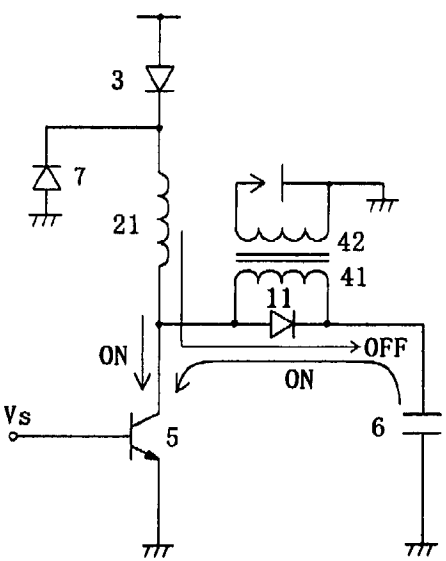

FIGS. 10B and 10C illustrate the variant of the circuit of FIG. 7. FIG. 10A is the same as the circuit configuration of FIG. 7, but FIG. 10B has the third diode 11 omitted from the circuit of FIG. 10A and a fourth diode 27 connected in parallel with the switching element 5. The fourth diode 27 is configured by an avalanche diode or a constant voltage diode, and ensures the current passage of when the switching element 5 is in the OFF state. In the circuit of FIG. 10B, the third diode 11 is not present, and the fourth diode 27 for bypassing the switching element 5 is present, and thus the capacitor 6 can be charged in the positive or the negative direction, and the free oscillating current flows to the capacitor 6. The direct current component of the primary coil 41 and the secondary coil 42 of the ignition coil 4 is thereby reduced, the copper loss in the ignition coil is suppressed, and heat generation is reduced.

FIG. 10C shows the third diode 11 connected in parallel with the primary coil of the ignition coil. In such circuit configuration as well, the free oscillation caused by the capacitor 6 and the primary coil 41 is suppressed, similar to FIG. 10A. However, in the circuit configuration of FIG. 10C, the current does not flow to the primary coil of the ignition coil when the switching element 5 is in the OFF state since the third diode 11 is connected to the ignition coil 4. Therefore, the inductive discharge is suppressed and only depends on the leakage inductance of the secondary coil 42 of the ignition coil 4. The capacitive discharge thus becomes domineering, and the switching of the switching element 5 is preferably limited to once.

Figure 11:
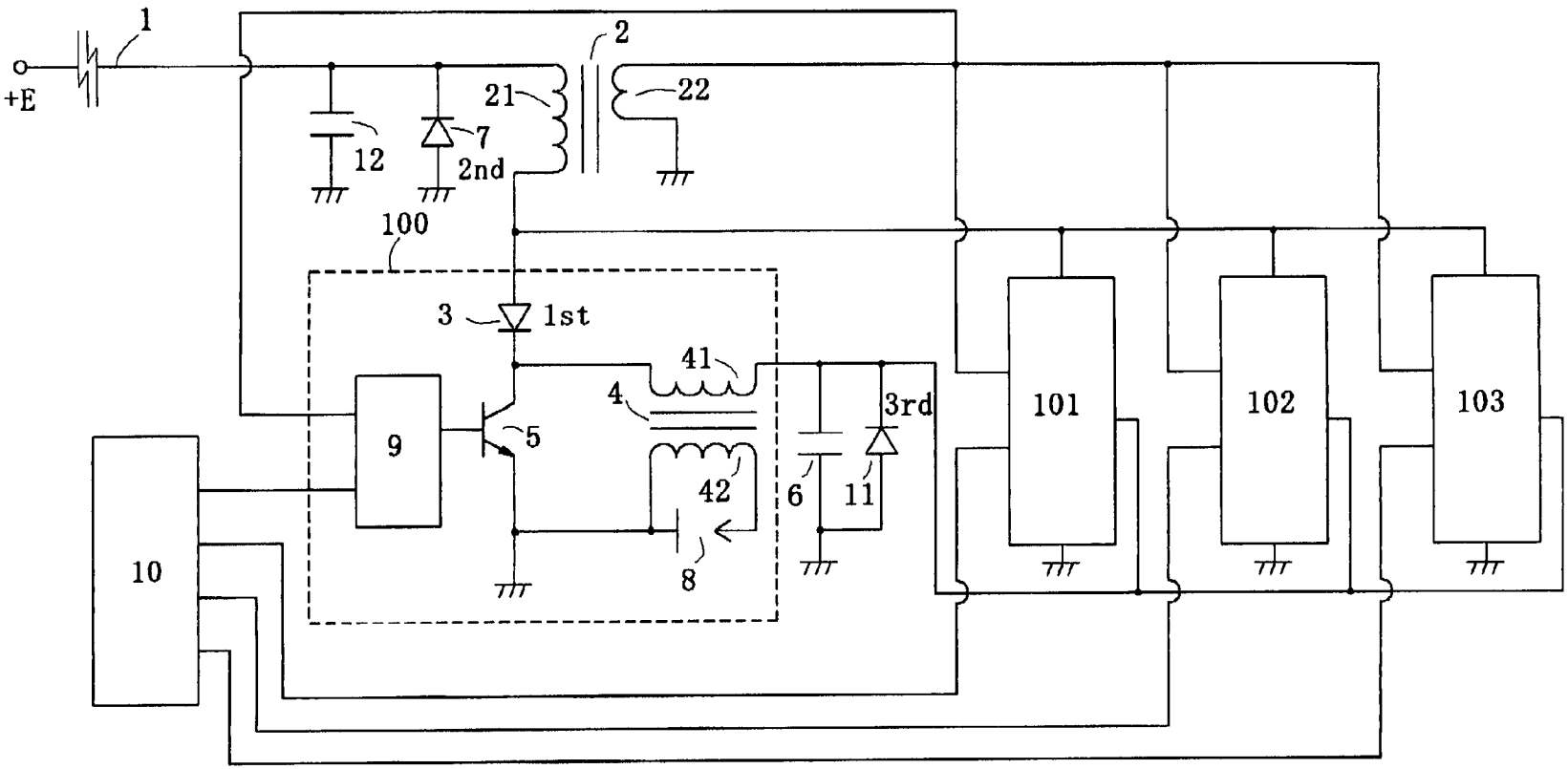
FIG. 11 is a circuit diagram showing another further variant of the ignition device of FIG. 7.
Figure 12A:
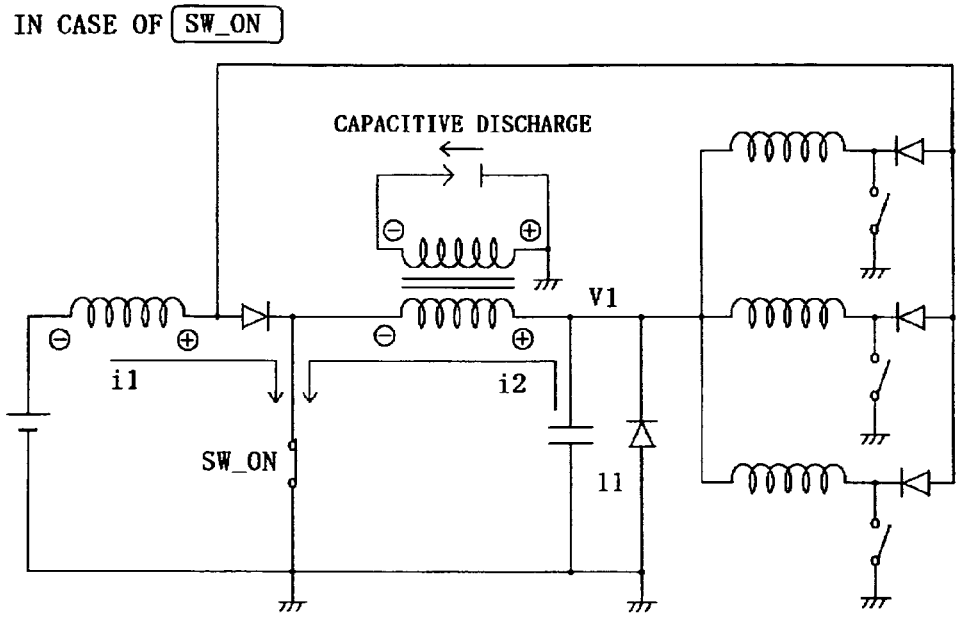
FIGS. 12A and 12B are views each showing the operation content of the ignition device of FIG. 11.
Figure 12B:
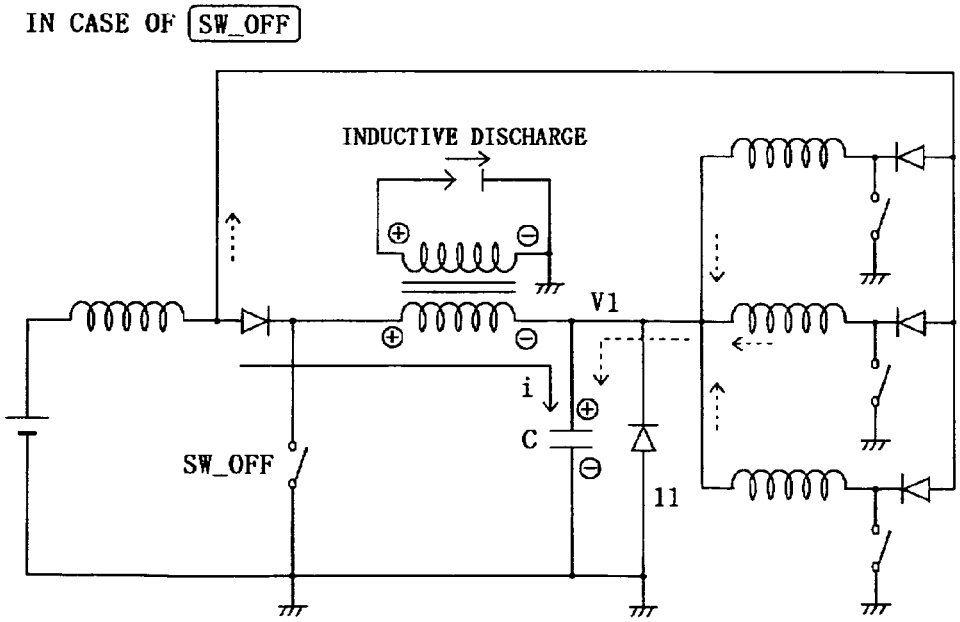
Figure 13:
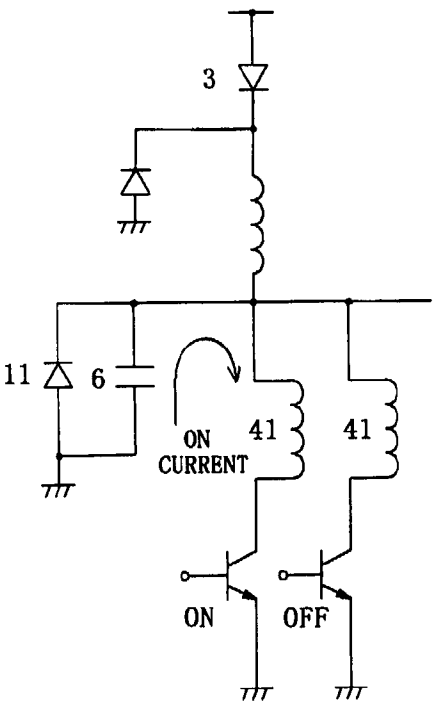
FIGS. 13A to 13C are views each explaining the operation content of FIG. 1 in comparison with other variants.
Figure 13:
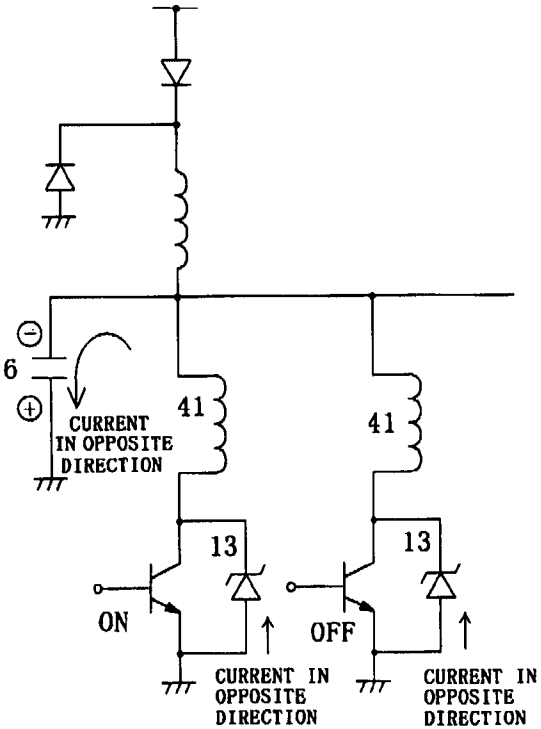
Figure 13:
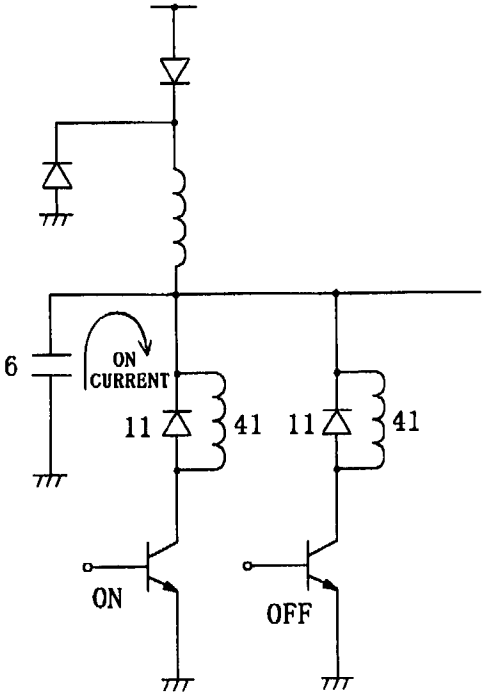

FIG. 11 shows a circuit example in which the circuit of FIG. 7 is further modified. In the circuit of FIG. 11, the capacitor 6 and the third diode 11 are commonly used by the four ignition units 100 to 103. The second diode 7, the capacitor 12 and the energy storage coil 21 are commonly used by the four ignition units, and the first diode 3 is arranged separately for each ignition unit. However, in the case of the circuit configuration, a problem arises in that the current also flows to the primary coil 41 of the ignition coil 4 of each ignition unit 100 to 103 when the switching element is in the OFF state (see FIG. 12B). However, since the ignition plug 8 that is already discharging is in the low impedance state, the current passage shown with a broken line is barely recognized as a problem, and the capacitor is mostly charged only with the current passage shown with a solid line.

Various multi discharge ignition devices have been illustrated, but the present invention is not particularly limited to each illustrated circuit configuration. For example, in a case of the circuit configuration of FIG. 1, the main components including the energy storage coil 21, the first diode 3, the capacitor 6 and the third diode 11 are not commonly used among all the ignition units, and taking into consideration that each component may break down, may be separately arranged to a certain extent. For example, they are preferably arranged one set for every two cylinders when the configuration of the internal combustion is four cylinders, one set for every three cylinders for six cylinders, or one set for every four cylinders for eight cylinders.

The switching element 5 shown in the example is not only the usual transistor, and IGBT, FET and the like may be appropriately selected. The ON/OFF operation time of the switching element 5 is appropriately changed and used by the power supply voltage that is recently becoming diversified, and the pulse cycle of the ignition pulse Vs is set short each time the power supply voltage increases.

In the ON/OFF control of the switching element 5, control is performed only with the upper limit value Imax of the conducting current value to the energy storage coil 21, without time setting the ON operation time. In the example, the current of the energy storage coil 21 is detected with all the ON operation times of the switching element 5, but control may be performed by detecting the current only at the last ON operation.

The terminal on the low voltage side of the secondary coil 42 of the ignition coil 4 is grounded in the example of FIG. 1, but may be connected to the primary coil 41. The function of the present invention is not lost even if the ion current detection circuit and the like for detecting the combustion state is connected to the ignition coil 4.

The current detection coil 22 is arranged separate from the energy storage coil 21 in each of the above embodiment, but an intermediate tap may be arranged in the energy storage coil 21, and the current of the energy storage coil 21 may be detected based on the output from the intermediate tap.

In either case, the accuracy of the detection value by the current detection coil is required when controlling the ON operation time of the switching element 5 based on the current value of the energy storage coil 21. Specifically, even if the current value of the energy storage coil 21 changes greatly, the magnetic flux amount of the energy storage coil 21 must increase linearly without saturating in correspondence thereto. Furthermore, the above properties are desirably achieved with a light and inexpensive coil.

In the ignition device of the present invention, the ignition energy of the first discharge that is extremely important to fuel ignition is determined by the magnetic energy discharged in the OFF operation of the switching element 5, that is, the amount of change in the magnetic flux per unit time. The discharged magnetic energy is stored in the energy storage coil 21, and thus the magnetic energy is determined by the magnetic flux density, the number of coil windings, and the current value of the energy storage coil 21. The magnetic flux density is substantially determined by the iron core material and the cross sectional area thereof In the present embodiment, a sufficient magnetic energy must be stored within a short period of 0.22 mS or 0.4 mS and the like, but the inductance value self-evidently has limits from the problems of spatial restrictions and cost, and the conducting current value also has limits at about 15 A taking into consideration the noise on other electronic equipments and power consumption. Therefore, the magnetic circuit must consequently be suitably designed to effectively function the present embodiment.

Figure 14A:
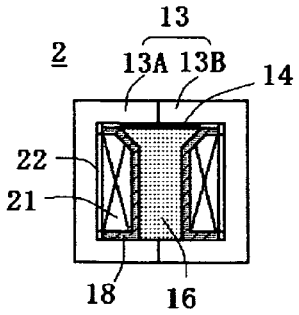
FIGS. 14A to 14C are views each explaining a suitable transformer configuration for realizing energy storage coil and current detection coil.

FIG. 14A illustrates the configuration of a transformer responding to the above requests. The transformer 2 is configured by a bobbin 18 on which the energy storage coil 21 and the current detection coil 22 are winded in layers, a center iron core 16 inserted into a central opening of the bobbin 18, a magnet 14 of rectangular plate shape polymerized on the center iron core 16, and external iron cores 13 (13A, 13B) that covers the bobbin 18. A powder sintered iron core, stacked iron core and the like are illustrated as the external iron core 13. The magnet 14 is preferably formed by neodymium or samarium cobalt.

Figure 14B:
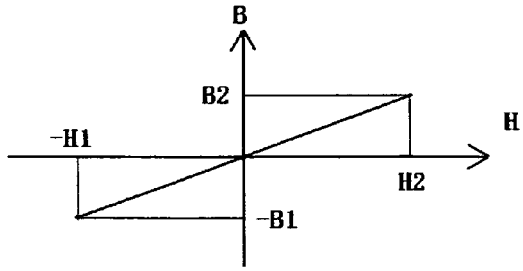
Figure 14C:
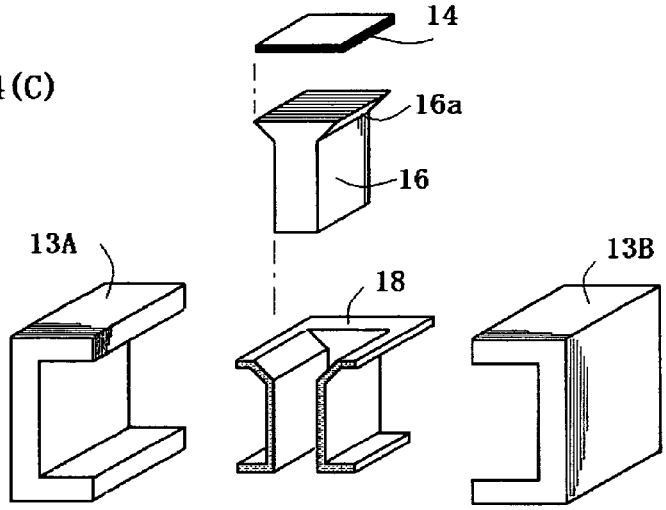

As shown in the figure, the center iron core 16 and the external iron core 13 configure an annular closed magnetic path. However, since the magnet 14 is arranged in the middle of the closed magnetic path and forms a gap, the BH characteristic as a whole is slightly gradually inclined, as shown in FIG. 14B. FIG. 14B shows the relationship between the magnetic field H generated by the current of the energy storage coil 21, and the magnetic flux density B. Actually, the BH characteristic becomes a magnetic hysteresis curve, but is shown as a straight line in FIG. 14B for the sake of convenience.

In the transformer 2, the magnet 14 is arranged in a direction of inhibiting the electromotive force (magnetic field H) caused by the current of the energy storage coil 21. As the current of the energy storage coil 21 increases from zero, the magnetic flux density increases from the initial position of (−H1, −B1) towards (+H2, +B2). Thus, the tolerable width of the current amplitude of the energy storage coil 21 is larger than when the magnet 14 is not arranged, and the current detecting function is effectively carried out without magnetically saturating the iron core even if the cross sectional area of the iron core is set small. Furthermore, only the magnetic field amplitude of up to 0 to H2 is tolerated when the magnet 14 is not arranged, but in the present embodiment in which the magnet 14 is arranged, a large amount of change in the magnetic flux is obtained since the magnetic field amplitude of −H1 to +H2 is tolerated, and a large electric charge amount effective in ignition can be accumulated in the capacitor 6.

Furthermore, in the present embodiment, the upper part 16*a* of the center iron core 16 is spread in a substantially Y-shape, and connected to the magnet 14. Thus, the width of the magnet 14 can be enlarged by the amount of spread to the Y-shape, and −B1 of FIG. 14B can be increased. Therefore, the tolerable width of the magnetic field amplitude (−H1 to +H2) becomes large in this sense as well.

Figure 15A:
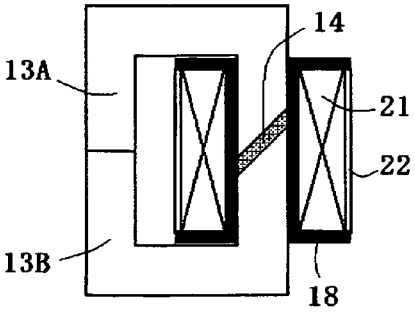
FIGS. 15A and 15B are views each showing a variant of FIGS. 14A to 14C.

FIG. 15A is an example in which a diagonal slit is formed in the external iron core, and the magnet 14 is arranged therein to further increase the magnetic field amplitude (−H1 to +H2). In this case, −B1 of FIG. 14B can be increased by the amount of arrangement of the diagonal slit. Furthermore, in this example, the energy storage coil 21 and the current detection coil 22 are winded so as to wrap the slits, and thus an advantage is obtained in that the leakage magnetic flux is smaller than in the configuration of FIG. 14A.

Figure 15B:
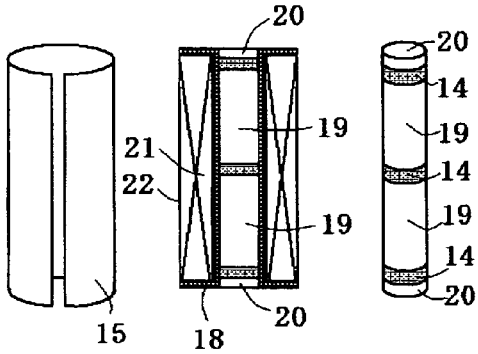

FIG. 15B illustrates another further embodiment. In this embodiment, columnar shaped center iron cores 19, disc shaped magnets 14, and disc shaped plate strips 20 are stacked and accommodated in the bobbin 18. The bobbin 18 is attached with a cylindrical plate material 15 after being stacked with the energy storage coil 21 and the current detection coil 22.

Soft iron and the like that is a weak magnetic body is used for the plate strip 20, where the repelling magnetic field by the magnet 14 is alleviated and the magnetic flux density B2 of target value is easily obtained when maximum magnetic field H1+H2 by the maximum current is applied. The plate strips 20 arranged at the top and the bottom may be one of either, or the center magnet 14 may be omitted.

The cylindrical plate material 15 is made of silicon steel plate and the like, and is inserted so as to cover the entire coil winding to reduce the leakage magnetic flux of the energy storage coil 21 and the current detection coil 22. Consequently, miniaturization and weight saving of the transformer are achieved, and at the same time, the degree of freedom of design is enhanced. The plate material 15 is not limited to one, and a plurality of the same may be attached.

The transformer configuration suitable for the present invention has been described, but the current detecting means is not limited to the transformer configuration, and the detection may obviously be performed with a resistor of a small resistance value connected between the emitter of the switching element 5 and the ground.

What is claimed is:

1. An ignition device configured to ignite an ignition plug, comprising:

a direct current power supply connection;

a ground terminal connection;

a damper element;

a first circuit connected between the direct current power supply connection and the ground terminal connection, the first circuit including a backflow prevention element, an energy storage coil, and a capacitor connected in series, the capacitor connected in parallel to the damper element;

a second circuit connected at both ends of the capacitor, the second circuit including a switching element and an ignition coil connected in series, the ignition coil having a primary and secondary side, the secondary side connected to the ignition plug; and a current detector configured to detect a value of a current of the energy storage coil or the switching element, wherein the switching element is configured to controllably perform a plurality of ON and OFF operations of the ignition device during an ignition operation of the ignition plug, the plurality of ON and OFF operations including a plurality of discharging operations in which a discharge direction through the secondary side repeatedly reverses, including an ON operation where current simultaneously flows from the energy storage coil and the capacitor to the primary side, and the current detector is configured to turn off the ignition device if the value of the current detected reaches a predetermined upper limit value.

2. The ignition device according to claim 1, wherein a plurality of the second circuit are connected commonly to both ends of the capacitor.

3. The ignition device according to claim 1, wherein the switching element is configured to change a number of switches between ON and OFF operations of the plurality of ON and OFF operations according to a rotation number or a load condition of an internal combustion device driven by the ignition plug, or a level of the power supply voltage.

4. The ignition device according to claim 1, wherein the ignition device is configured to dynamically change a parameter of an ON operation of the plurality of ON and OFF operations according to a rotation number or a load condition of an internal combustion device driven by the ignition plug, or a level of the power supply voltage.

5. The ignition device according to claim 4, wherein the parameter is an operation time of a first ON operation of the plurality of ON and OFF operations.

6. The ignition device according to claim 4, wherein the parameter is an operation time of a last ON operation the plurality of ON and OFF operations.

7. The ignition device according to claim 1, wherein a last ON operation time of the plurality of ON and OFF operations is longer than previous ON operation times.

8. The ignition device according to claim 1, further comprising:

a magnetic circuit operatively connected to the energy storage coil and including a magnet having a polarity opposite to a magnetic flux direction of the energy storage coil during conduction period.

9. The ignition device according to claim 1, further comprising:

a current detection coil, the current detection coil being a part of the energy storage coil or being an auxiliary coil electromagnetically coupled to the energy storage coil.

10. The ignition device according to claim 1, wherein the predetermined upper limit value includes a first predetermined upper limit value and a second predetermined upper limit value, the second predetermined upper limit value associated with a final ON operation of the plurality of ON/OFF operations and being higher than the first predetermined upper limit value.

11. The ignition device according to claim 8, wherein the magnetic circuit is formed into an annular shape, and the magnet is arranged in a slit formed in the middle.

12. The ignition device according to claim 8, wherein the magnetic circuit is configured by a magnetic body of linear rod shape, and the magnet is arranged at least one location of substantially the central part or both ends of the rod shaped magnetic body.

13. The ignition device according to claim 12, further comprising:

a magnetic body strip having lower magnetism than the magnet, the magnetic body strip arranged in continuation from the magnet to at least one end of the rod shaped magnetic body.

14. An ignition device configured to ignite an ignition plug and including a direct current power supply connection, a ground terminal connection, and an ignition coil having a primary and secondary side, the ignition device comprising:

means for controllably performing a plurality of ON and OFF operations of the ignition device during an ignition operation of the ignition plug, the plurality of ON and OFF operations including a plurality of discharging operations in which a discharge direction through the secondary side repeatedly reverses, and means for turning off the ignition device if a detected current reaches a predetermined upper limit value.

* * * * *